United States Patent [19]

Kalert et al.

[11] 3,963,670

[45] June 15, 1976

[54] INTEGRATED IDLE AND BY-PASS SYSTEM

[75] Inventors: Ralph E. Kalert, Granite City, Ill.; Robert J. Smith, Florissant, Mo.

[73] Assignee: ACF Industries, Incorporated, New York, N.Y.

[22] Filed: Mar. 7, 1975

[21] Appl. No.: 556,250

[52] U.S. Cl. ..... 261/41 D; 123/DIG. 11

[51] Int. Cl.[2] ..... F02M 3/02

[58] Field of Search ..... 261/41 D, 23 A; 123/DIG. 11

[56] References Cited

UNITED STATES PATENTS

| | | | |
|---|---|---|---|
| 1,002,699 | 9/1911 | Jouffret et al. | 261/41 D |
| 1,289,300 | 12/1918 | Stokes | 261/41 D |
| 1,612,597 | 12/1926 | Alexandrescu | 261/41 D |
| 2,752,132 | 6/1956 | Nye | 261/41 D |
| 2,786,659 | 3/1957 | Mennesson | 261/41 D |
| 2,824,726 | 2/1958 | Dietrich et al. | 261/41 D |
| 3,304,068 | 2/1967 | Thomas | 261/41 D |
| 3,503,594 | 3/1970 | Goto | 261/41 D |
| 3,544,083 | 12/1970 | Currie | 261/41 D |
| 3,677,526 | 7/1972 | Pierlot | 261/41 D |

FOREIGN PATENTS OR APPLICATIONS

| | | | |
|---|---|---|---|
| 202,835 | 6/1955 | Australia | 261/41 D |
| 708,526 | 5/1954 | United Kingdom | 261/41 D |

*Primary Examiner*—Tim R. Miles

[57] ABSTRACT

A carburetor is disclosed which includes a supplementary fuel/air supply circuit for bypassing a throttle valve to provide a fixed fuel/air idle mixture. The supplementary fuel/air supply circuit includes separate fuel and air passageways which join at a mixing intersection. The mixing intersection communicates with a main bore of the carburetor at a point below a throttle valve thereof. The supplementary fuel/air supply circuit also includes a piston valve, which is responsive to manifold vacuum, to control flow of air through the air passageway so that the air passageway is open during periods of high manifold vacuum but closed during periods of low manifold vacuum. An idle-mixture adjusting screw is provided for adjusting air flow through the air passageway; a piston-stop adjusting screw is provided for tuning the position of the piston valve at its "closed" position; and, in one embodiment, a special plug is provided for holding the piston valve in a piston chamber.

3 Claims, 3 Drawing Figures

INTEGRATED IDLE AND BY-PASS SYSTEM

BACKGROUND OF THE INVENTION

This invention relates generally to the art of carburetors and more specifically to carburetors having by-pass air passageways for by-passing throttle valves thereof.

Public policy is increasingly requiring that new automotive vehicles be equipped with apparatus for controlling the emissions of noxious fumes from exhaust systems of such vehicles. In this regard, it is generally well known that running automotive vehicles at excessively rich mixtures produces more unburned carbons than is generally desired. In the past, carburetor idle circuits have often been among the worst offenders of providing excessively rich mixtures because mechanics have employed rich mixtures in order to make engines idle smoothly. In this respect, one reason it is difficult to obtain a smooth idle is that decreased air flow results in uneven distribution of idle fuel charges.

Engineers have employed several methods to overcome this uneven distribution problem. For example, they have increased idling speeds so as to get greater air flow and increased engine temperatures to improve vaporization.

Some manufacturers have drilled air bleed holes in throttle plates so as to increase air flow and thereby deliver more uniform distributions of fuel/air mixtures to combustion chambers. However, the sizes and placements of such throttle plate holes have been extremely critical to their effectiveness. Some manufacturers have included by-pass idle air systems in their throttle flanges for by-passing air around throttle valves. In such cases air is taken from above the throttle valves through passages and discharged into bores below the throttle valves. Some of these air by-pass systems have discharge ports adjacent to the idle-circuit fuel-discharge ports and some share discharge ports with the idle circuit, for example, see U.S. Pat. No. 2,763,285 to Reeves.

A difficulty which is sometimes encountered when employing a supplementary air by-pass circuit is that, because modern automotive vehicles idle at such fast speeds, when their ignition switches are turned off they often continue to run due to a "dieseling" action. Thus, it is an object of this invention to provide a supplementary by-pass air circuit which tends to prevent "dieseling" when an engine is turned off.

Another difficulty with some prior art air by-pass circuits is that the orientation and locations of discharge ports thereof have been extremely critical, thus, making them difficult and expensive to manufacture. Therefore, it is an object of this invention to provide a supplementary air by-pass system in which the orientation and location of a discharge port is not as critical as in prior art devices.

Still another difficulty with some prior art supplementary air by-pass circuits is that they were unduly difficult to manufacture because they do not allow easy adjustment to produce optimum desirable fuel/air mixtures. Therefore, it is yet another object of this invention to provide a supplementary air by-pass system which allows easy fuel/air mixture adjustment after manufacture.

It is still another object of this invention to provide a supplementary air by-pass system which is relatively inexpensive to manufacture and not unduly complex in structure.

SUMMARY OF THE INVENTION

According to principles of this invention, a carburetor has a supplementary fuel/air supply system which includes a supplementary air by-pass passageway and a separate supplementary fuel passageway. The supplementary air passageway by-passes a throttle valve and the separate supplementary fuel passageway provides communication between a fuel supply bowl and a mixing intersection of the supplementary air passageway. The throttle valve is designed to close the carburetor bore completely when it is in a "closed" position. Thus, the supplementary fuel/air supply circuit not only provides a mixture of fuel and air to an intake manifold, but during periods of idling it may provide a substantially exclusive source of air for the engine. A piston valve is included in the supplementary air passageway, upstream of the mixing intersection. The piston valve is in communication with an intake manifold and the manifold vacuum therefrom opens the piston valve during periods of high manifold vacuum, but allows a spring to close the piston valve during periods of low manifold vacuum. Thus, a supplementary fuel/air mixture is provided to the intake manifold during periods of idle, but not during periods of high engine loading. Further, when the engine is turned off, the piston valve closes to cut off a major portion of air to the engine and thereby prevent dieseling.

The supplementary fuel/air supply circuit also includes an air flow adjusting screw in the supplementary air passageway for regulating the maximum flow of air therethrough and an idle mixture adjusting screw in the supplementary fuel passageway for controlling the flow of fuel therethrough.

Further, there is included a piston stop adjusting screw for tuning the position of the piston valve when it is in a "closed" position.

BRIEF DESCRIPTION OF THE DRAWINGS

The foregoing, and other objects, features and advantages of the invention will be apparent from the following more particular description of a preferred embodiment of the invention as illustrated in the accompanying drawings in which reference characters refer to the same parts through the different views. The drawings are not necessarily to scale, emphasis instead being placed upon illustrating principles of the invention in a clear manner.

DESCRIPTION OF PREFERRED EMBODIMENTS

Figure 1:
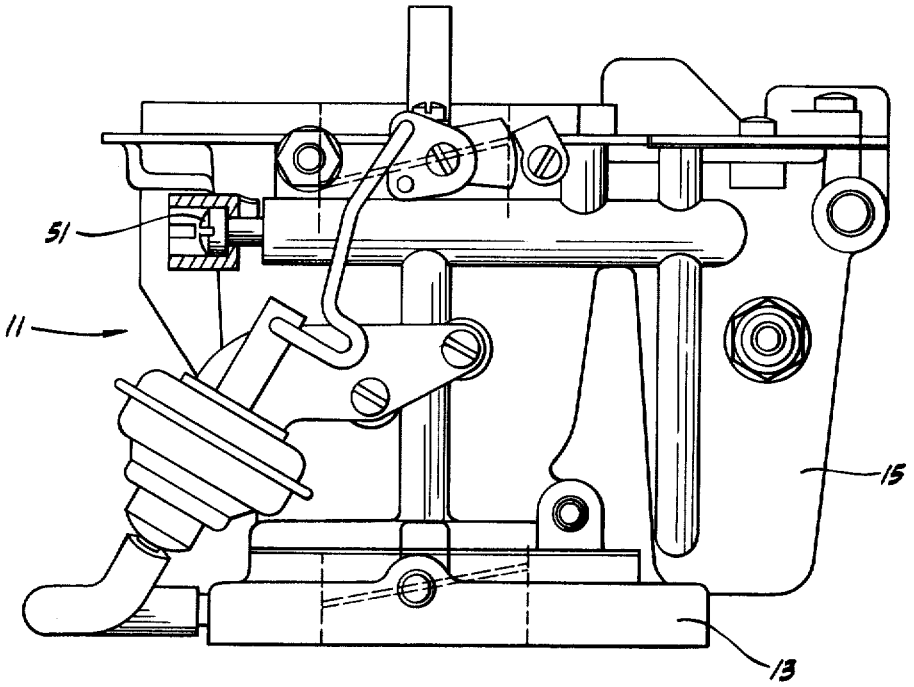
FIG. 1 is a side-view of a carburetor employing principles of the invention.

A carburetor 11 is attached at a lower flange 13 thereof to an intake manifold (not shown). The carburetor 11 includes a fuel bowl 15 and two bores 17 and 19. In this regard, the carburetor depicted in the drawings is sometimes referred to as a progressive-stage dual carburetor wherein a primary throttle valve 21 opens through a lower power, or speed, range after which a secondary throttle valve 23 begins to open. This feature, however, is not of substantial importance to this invention and, therefore, will not be described in greater detail.

Figure 2:
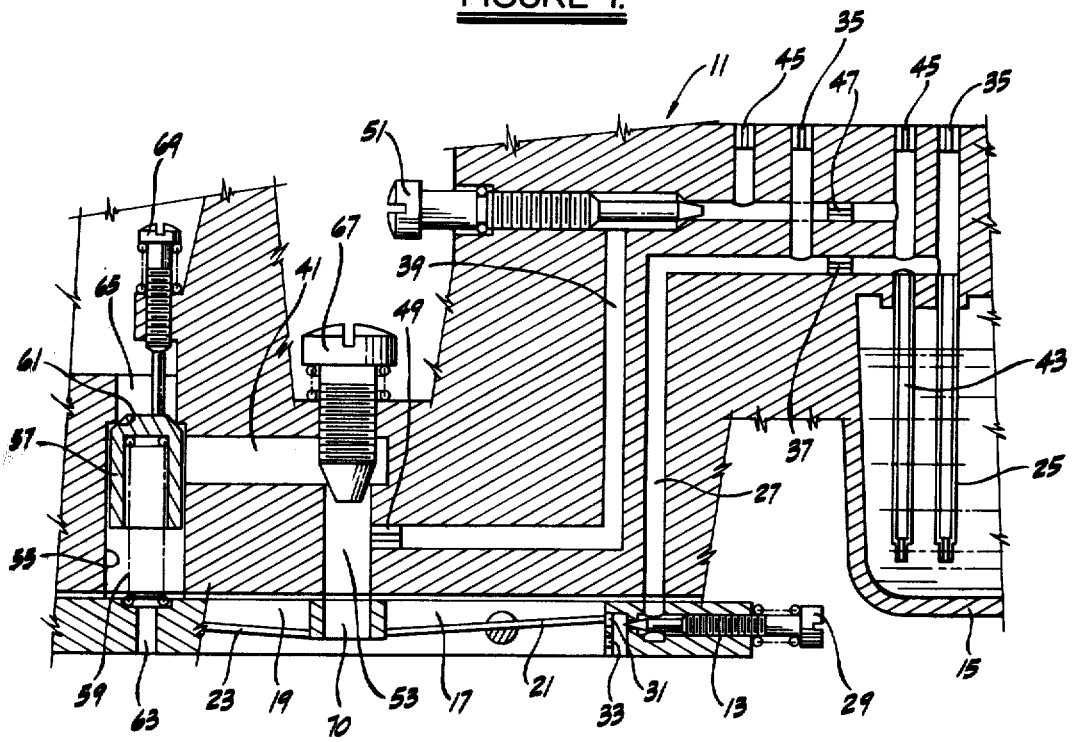
FIG. 2 is a schematic sectional-type view of a carburetor which is arranged so as to depict essential passages and elements of the invention.

It should be particularly noted that the primary and secondary throttle valves 21 and 23 are depicted in FIG. 2 in the "closed" positions. That is, they virtually "close off" the first and second bores 17 and 19. This is different from most carburetors where air for idle mixtures flows around throttle valves.

Carburetor 11 includes a standard low speed, or idle, circuit which basically comprises an idle jet 25, an idle passage 27, an idle adjustment screw 29, and first and second idle ports 31 and 33. Also included are idle bleed passages 35 and an economizer 37. The first idle port 31 is a dynamic air idle port through which fuel is sucked by a negative pressure which is created by a flow of air past the primary throttle valve 21 as it opens and closes. The second idle port 33 allows some fuel to enter the first bore 17 in response to a high vacuum in the first bore 17, but along with the idle adjustment screw 29, its primary function is to control the pressure difference applied to the idle circuit.

The carburetor 11 also includes a supplementary fuel/air supply circuit which includes a fuel passageway 39, with associated portions and elements which will now be described.

The fuel passageway 39 includes a supplementary fuel jet 43, bleed passages 45 and economizers 47 and 49. An idle mixture adjusting screw 51 is adjustable relative to a carburetor main body 52 to provide for adjusting the amount of fuel which flows through the fuel passageway 39 in response to a vacuum appearing at a mixing intersection 53 in the air passageway 41.

The air passageway 41 includes a piston chamber portion 55 in which a piston valve 57 moves. The piston valve 57 is biased by a calibrated spring 59 toward a piston valve seat 61. In this regard, when the piston valve 57 is seated, air flow is prevented through the air passageway 41. Since the piston valve 57 and the throttle valves 21 and 23 are all depicted as being closed in FIG. 2, the engine on which the carburetor 11 is mounted is not operating because it cannot get sufficient air.

The piston chamber portion 55 communicates through a manifold vacuum passageway 63 with the intake manifold (not shown). In this regard, a high intake manifold vacuum acts on the piston valve 57 to pull in downwardly, as seen in FIG. 2, to thereby allow air flow from an initial portion 65 of the air passageway 41 to flow past the mixing intersection 53 to the bores 17 and 19 at points below the primary and secondary throttle valves 21 and 23.

An air-flow adjusting screw 67 is provided for limiting the maximum quantity of air that flows through the air passageway 41.

A piston-stop adjusting screw 69 can be adjusted relative to the carburetor main body 52 to hold the piston valve 57 slightly off its seat 61 so as to standardize air leakage through the carburetor 11.

In operation, the air-flow adjusting screw 67 and the idle-mixture adjusting screw 51 are set to provide an optimum curb-idle mixture at the mixing intersection 53. During periods of idle, or near idle, the manifold vacuum acts through the manifold vacuum passageway 63 to pull the piston valve 57 downwardly, thereby allowing air to flow through the air passageway 41. This air flow through the mixing intersection 53 causes a vacuum to suck gas from the fuel passageway 39. This fuel mixes with the air and the mixture is injected into the bores 17 and 19 below the throttle valves 21 and 23 at a slot 70.

When the engine's ignition system is turned off, the manifold vacuum drops down quite low and the piston valve 57 moves to a blocking position, as shown in FIG. 2, whereby little air flows through the air passageway 41. Thus, mixed air and fuel is no longer injected by the supplementary fuel/air supply circuit at the slot 70. Further, since the throttle valves 21 and 23 also prevent flow of air through the bores 17 and 19 when they are closed, the engine fails to get air and dieseling of the engine is thereby prevented. At cranking, at least part of the fuel for starting would be drawn from orifice 49.

It is important to note that, in this invention, the throttle valves 21 and 23 are virtually closed during curb idle. In this regard, the quantity of air that is required for curb idle is provided through the air passageway 41. Fuel for curb idle is provided both through the fuel passageway 39 and the idle passage 27. Thus, when the piston valve 57 closes, it essentially cuts off the engine's air supply.

Another feature of this invention is that the fuel/air mixture provided by the supplementary by-pass air system is substantially fixed during periods of "curb idle". Further, since this mixture is created above the throttle valves, it is quickly uniformly distributed after leaving slot 70, and the orientation and location of the slot 70 are not unduly critical thereto.

Figure 3:
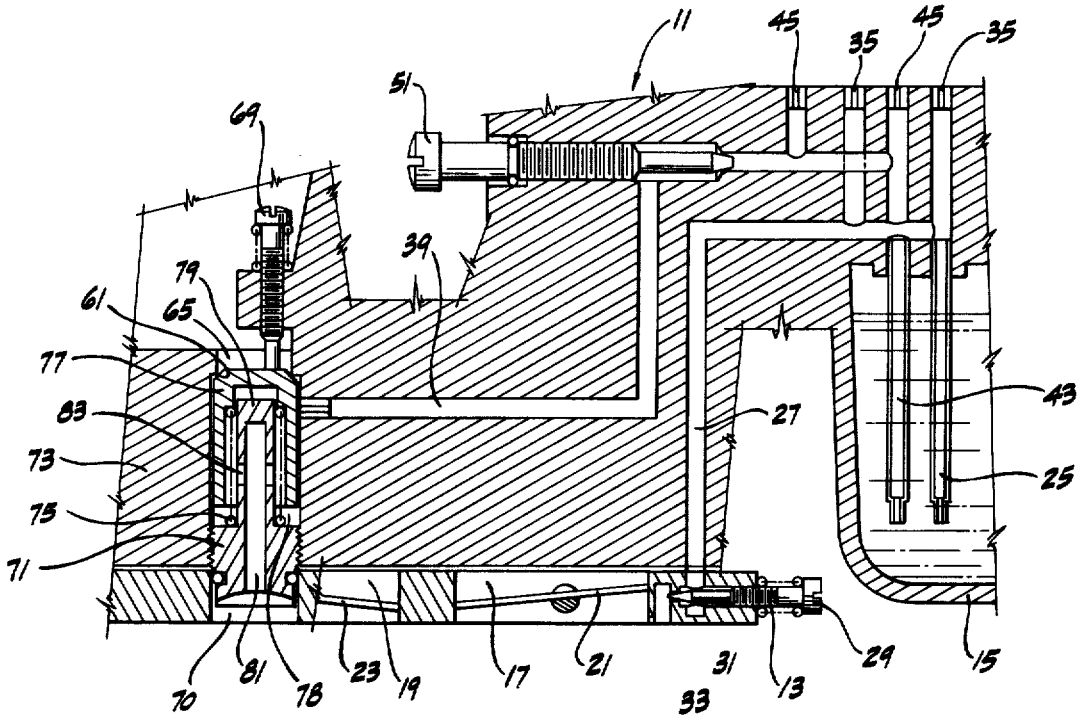
FIG. 3 is a schematic sectional-type view of an alternate embodiment of a piston chamber portion of the invention illustrated in FIG. 2.

FIG. 3 depicts a modified embodiment of the piston chamber portion of the invention illustrated in FIG. 2. In this respect, the remaining portions of the FIG. 3 embodiment are the same as the FIG. 2 structure. Hence, for simplicity some of the structure such as the air adjusting screw 67 are deleted from FIG. 3. Therein, a plug 71 is screwed into a carburetor main body 73 to retain a calibrated spring 75 and a piston valve 77 in a piston valve chamber 78. The plug 71 includes a protruding portion 79 and has a central bore 81 communicating with horizontal opening 83. The protruding portion 79 of the plug 71 limits downward movement of the piston valve 77. Manifold vacuum is allowed to communicate with the piston valve 77 through the central bore 81 and the horizontal openings 83. Otherwise, the embodiment of FIG. 3 functions similarly as does the embodiment of FIG. 2.

While the invention has been particularly shown and described with reference to preferred embodiments, it will be understood by those skilled in the art that various changes in form and detail may be made therein without departing from the spirit and scope of the invention. For example, the supplementary fuel/air supply system of this invention could be used with a single-barrel carburetor, a two-barrel carburetor or a four-barrel carburetor as well as with a progressive stage-dual carburetor.

The embodiments of the invention in which an exclusive property or privilege are claimed are defined as follows:

We claim:

1. A carburetor to be mounted on an intake manifold of an internal combustion engine to provide a fuel/air mixture to be sucked into the intake manifold by an intake manifold vacuum, said carburetor including:

a main fuel/air mixing bore in communication with outside atmosphere;

a fuel supply bowl;

a throttle valve located in said mixing bore for moving between an open and a closed position and thereby controlling fluid flow through said mixing bore, wherein, when said throttle valve is in said "closed" position, fluid flow through said main fuel/air mixing bore is virtually prevented;

an idle fuel supply circuit for providing communication between said fuel supply bowl and said main fuel/air mixing bore, said idle fuel supply circuit entering said main fuel/air mixing bore at a dynamic air idle port which is located adjacent said throttle valve so that fluid flow in said main fuel/air mixing bore past said dynamic air idle port is effected by movement of said throttle valve, and fuel flow from said dynamic air idle port into said main fuel/air mixing chamber is, in turn, effected; and a supplementary fuel/air supply circuit comprising:

an air passageway defining means for defining a supplementary air passageway leading from a point upstream of said throttle valve to a point downstream of said throttle valve;

a fuel passageway defining means for defining a separate supplementary fuel passageway from said fuel supply bowl to said supplementary air passageway, said supplementary fuel passageway entering said supplementary air passageway at a mixing intersection;

a piston valve located in a piston chamber portion of said supplementary air passageway upstream of said mixing intersection, said piston valve being movable in said piston chamber portion between a blocking position wherein said piston valve substantially blocks air flow through said supplementary air passageway, and an open position wherein said piston valve allows substantial free air flow through said supplementary air passageway;

a biasing spring for biasing said piston valve toward said blocking position;

a manifold vacuum passageway defining means for defining a manifold vacuum passageway between said piston chamber portion and said intake manifold, said manifold vacuum passageway entering said piston chamber portion at such a location that a predetermined high manifold vacuum acting through said manifold vacuum passageway under idle conditions overcomes said biasing spring and moves said piston valve toward an open position; and a plug which is screwed into a main housing of said carburetor behind said piston valve, said plug including a protruding portion thereof which extends into a hollow portion of said piston valve, said plug defining a central bore and an opening communicating with said central bore through said protruding portion of said plug so that said opening provides communication between said central bore and said hollow portion of said piston valve, and wherein said central bore communicates with an intake manifold vacuum and the length of said protruding portion is calibrated so as to provide a stop for said piston valve when it is in an open position.

2. A carburetor as claimed in claim 1 and further including an air flow adjusting screw in said supplementary air passageway downstream from said piston valve and upstream of said mixing intersection for adjusting air flow through said supplementary air passageway.

3. A carburetor as claimed in claim 2 and further including a piston-stop adjusting screw for adjusting the position of said piston valve relative to a piston valve seat when it is in said blocking position.

* * * * *